United States Patent [19]

Martin, Jr. et al.

[11] Patent Number: 4,693,394

[45] Date of Patent: Sep. 15, 1987

[54] APPARATUS AND METHODS FOR DISPENSING COMPACTED MATERIALS

[75] Inventors: Timothy J. Martin, Jr., 1328 Pangborn Rd., Lynden, Wash. 98264; Richard T. Henry, Bellingham, Wash.

[73] Assignee: Timothy J. Martin, Jr., Lynden, Wash.

[21] Appl. No.: 694,414

[22] Filed: Jan. 24, 1985

[51] Int. Cl.[4] ..... B65G 69/06

[52] U.S. Cl. ..... 222/1; 222/195; 222/637; 366/101; 406/136

[58] Field of Search ..... 222/195, 630, 637, 1; 406/136, 137, 138; 366/101, 102, 106, 107; 138/106

[56] References Cited

U.S. PATENT DOCUMENTS

| | | | |
|---|---|---|---|
| 2,988,286 | 6/1961 | Snyder et al. | 239/229 X |
| 3,942,689 | 3/1976 | Dakin et al. | 222/195 |
| 3,999,750 | 12/1976 | Perkins | 222/195 X |
| 4,466,558 | 8/1984 | Dugge et al. | 222/195 |

FOREIGN PATENT DOCUMENTS

| | | | |
|---|---|---|---|
| 957660 | 11/1974 | Canada | 222/195 |
| 247744 | 2/1926 | United Kingdom | 222/195 |

*Primary Examiner*—Joseph J. Rolla
*Assistant Examiner*—Frederick R. Handren
*Attorney, Agent, or Firm*—Hughes & Cassidy

[57] ABSTRACT

There is disclosed a flexible, hollow, tubular member for conducting a fluid therethrough to cause the tubular member to move in a whip-like manner inside a container. The conduction of fluid therethrough causes the tubular member to move in a generally upward direction through material in the container while producing whip-like motions of the tubular member to agitate compacted portions of the material and cause the material to discharge from the container. The container may include a passageway covered by an entry/sealing means which includes a one way flap or a flexible tubular housing to permit insertion of the tubular member enclosed by a tubular housing into the container, while preventing the escape of material from the container when the tubular member/housing has been removed. Retraction of the tubular housing relative to the flexible tubular member providing a substantially exposed section of the tubular member to allow for the random, whip-like movement of the tubular member in the container. The entry/sealing means are located at various portions of the container to permit selected insertion of the housing/tubular member into the container. A portion of the tubular housing may be angled at one end thereof such that rotation of the tubular housing displaces the angled end portion within the container. In addition, the flexible tubular member may be engaged by a rotary motor to cause the tubular member to be displaced radially through 360° of rotation. Air is conducted through the hollow tubular member to impart to the tubular member a whip-like motion wherein the movement of the tubular member within the container is defined by the combination of the radial displacement and the whip-like motion.

12 Claims, 18 Drawing Figures

FIG. 5A
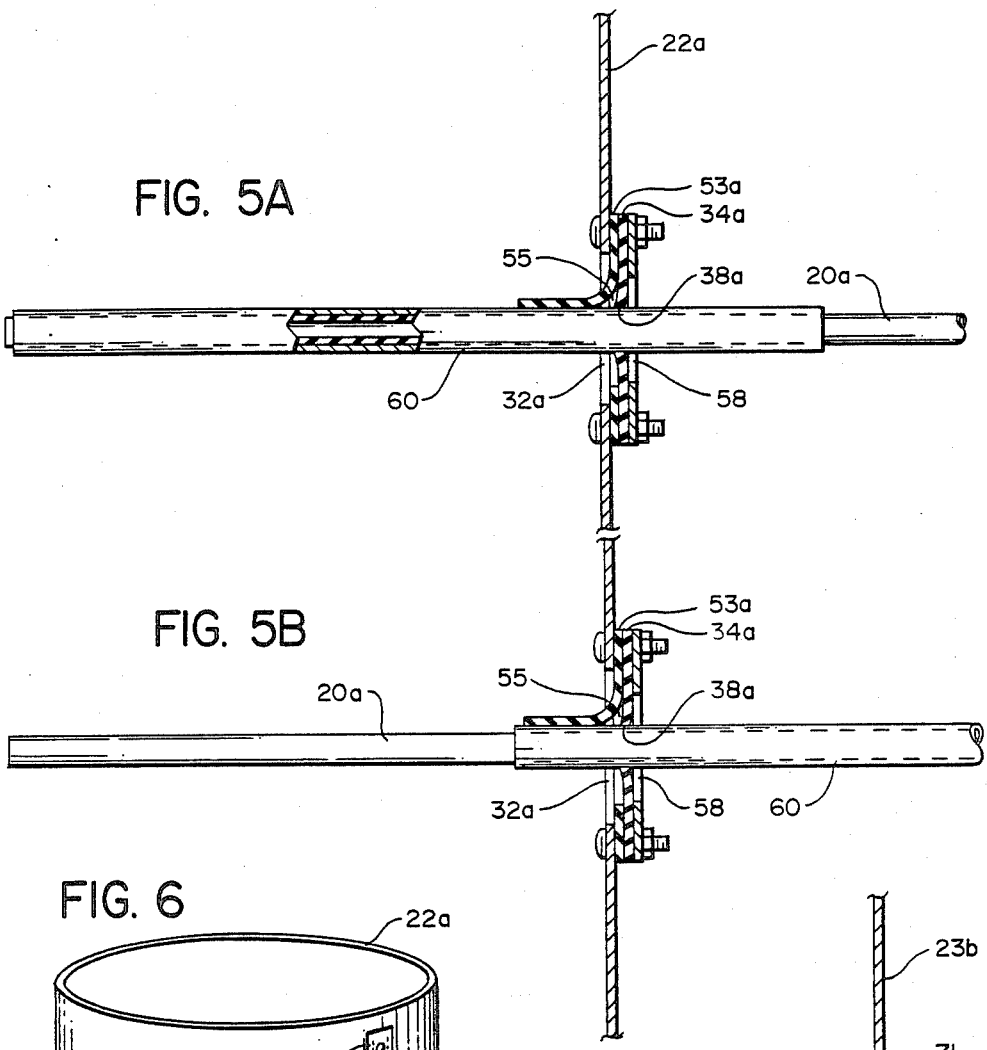
FIG. 5B
FIG. 6
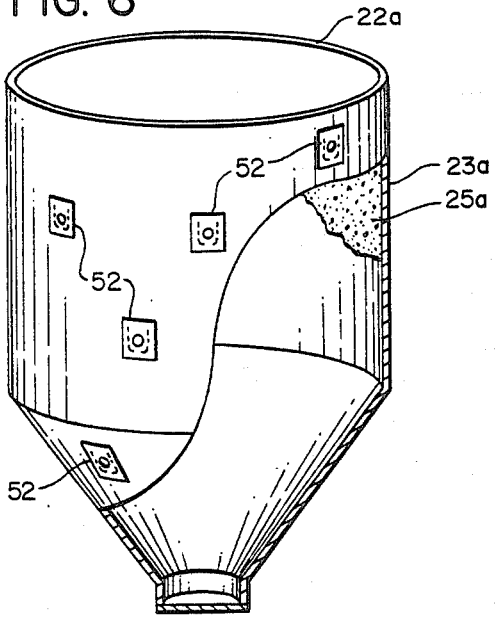
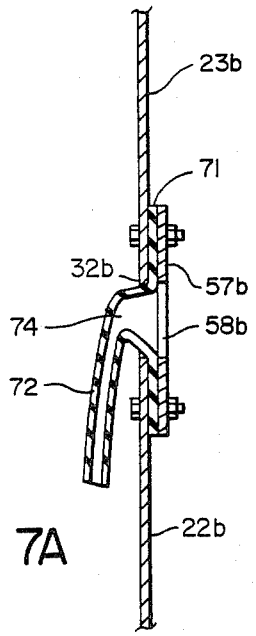
FIG. 7A

APPARATUS AND METHODS FOR DISPENSING COMPACTED MATERIALS

TECHNICAL FIELD

The present invention relates to apparatus and methods for dispensing compacted materials from a container, and more particularly to apparatus and methods for dispensing compacted materials utilizing a flexible, tubular member propelled in a whip-like manner to strike the compacted material causing its dispersal from a container.

BACKGROUND OF THE INVENTION

Quite commonly particulate material such as asbestos, cement, grain, sand or the like is transported or stored in a hopper having an inwardly tapered lower end portion that terminates in a lower discharge opening. These hoppers can be, for example, stationary structures at a storage location, or part of the structure of a railroad freight car. Quite often there is a tendency for the material to adhere together or to "cake" above the discharge outlet, thus preventing further discharge of the material from the hopper.

One common method for remedying this problem is for a workman simply to pound on the side of the hopper, e.g., with a sledge hammer or some other blunt object to jar the caked material loose. Another method is simply to use a rod or other object to probe into the caked material to knock it loose. There have in the past been various proposals to employ mechanical devices to alleviate this problem, such as moving members to continually agitate and stir the material to prevent compaction, or flexible tubes which are attached to a fluid source, such as air, so that the tubes randomly whip about the inside of the container to continually agitate the material. However, to the best knowledge of the applicant, such mechanical devices have not been widely accepted commercially, so that the common remedy remains the impacting of the sides of the hopper or using manually operated rods or poles to jar the material loose. A search of the patent literature has disclosed a number of concepts utilizing a pressurized fluid medium to effect the loosening of the caked material in a hopper. These are as follows: In U.S. Pat. No. 2,025,404 —Stahn, there is disclosed apparatus for dispelling sand which has stuck to the walls of a container, the apparatus includes a flexible tube vertically suspended inside the container wherein compressed air is supplied to the tube to cause it to move in a whip-like manner. In addition, in U.S. Pat. No. 2,115,023—Kennedy, et al, there is disclosed means for handling pulverulent, granular like materials, including a container for the materials and a flexible tubular member vertically suspended within the container in communication with an air source which causes the flexible hose to move in a whip like manner to dislodge material adhering to the container.

A fluidly propelled tubular flexible member has also been used to stir the contents inside a container such as in U.S. Pat. No. 2,501,047 —Gustafson, et al, where there is disclosed a dry powder sprayer, including a flexible tube vertically suspended inside a container containing therein a powder mass; a flexible tube in communication with an air source causes the tube to flap around in the container to nebulate and aerate the powder mass.

Frequently these tubular members are permanently mounted to the container utilizing a variety of mounting and sealing methods. In U.S. Pat. No. 3,942,689—Dakin, Jr., et al, there is disclosed a vertical guide member permanently supporting a flexible tubing slideably engaged within the guide member to permit varying the elevation of the guide member relative to the tube. The slideably engaged tubing allowed the exposed length of the tube to be varied in order to dislodge compacted materials from increasing heights within the container. A mechanical seal or stuffing box provided a seal between the guide member and the container.

In order to provide additional area coverage within the container, additional tubular members are often spaced about the inside of the container and connected to a common manifold. In. U.S. Pat. No. 3,777,912—Deeks, there is disclosed an apparatus for removing material from hopper-type railroad tank cars wherein rubber hoses are suspended over each hopper symmetrically about the transverse centerline and on the longitudinal centerline. The top ends of the hoses are fixed to air supply pipes which are held rigid by structural supports.

A plurality of flexible tubing members are also utilized for mixing the contents of a container such as in U.S. Pat. No. 2,988,286—Snyder, et al, wherein there is disclosed a plurality of flexible hoses suspended from a pipe across the inside of a liquid container, the hoses are connected to a liquid source which when activated causes liquid to flow through the hoses into the container causing the hoses to move in a whip-like manner to stir the contents of the container.

A plurality of flexible tubular hoses has also been used as cleaning apparatus such as in U.S. Pat. No. 3,799,444—Reed, wherein there is disclosed an apparatus for removing material from a workpiece, the apparatus comprising a plurality of flexible rubber tubes supplied with compressed air through a manifold mounted longitudinally across the inside of a cleaning container. The manifold is mechanically moved laterally across the inside of the container in a direction perpendicular to the longitudinal axis of the cross beam so that the rubber tubes are whipped against the entire surface of the workpiece.

Other apparatus for assisting the discharge of compacted cargo materials include U.S. Pat. No. 3,337,094—Houston, wherein there is disclosed a grain storage container including a plurality of fluid-type tubes therein which when filled with fluid occupy a larger volume which produces forces in a generally horizontal direction throughout the material to dislodge the material from the container. In U.S. Pat. No. 3,933,280—Plumb, there is disclosed a bulk cargo unloader aerator including an insertable and removeable aerating assembly comprising a rigid tube having a plurality of holes therein and covered by a porous fabric sleeve which is caused to pulsate due to fluctuations in an air supply such that the pulsating fabric impacts material in a storage hopper. The hopper includes a laterally projecting neck which is provided with a coupling arrangement to mate with the aerating assembly.

In U.S. Pat. No. 3,833,151—Lieckfeld, there is disclosed apparatus for assisting the discharge of particulate solids from a bin wherein a hollow body is attached to the bottom of the bin and caused to expand and contract by the action of a counter weight attached to the top of the hollow body and suspended outside the bin.

In U.S. Pat. No. 3,237,389—Green, there is disclosed a fruit picking apparatus utilizing a plurality of flexible tubular members mounted on a boom for conducting pressurized fluid which imparts to the tube a whip-like movement to dislodge fruit from a tree.

It should be appreciated that a number of apparatus and methods have been utilized to assist in the discharge of compacted material from storage containers. Typically a plurality of these devices are disposed at selected locations throughout the container to provide adequate dislodging of materials from all portions of the container. A large container requires an increased number of dislodging devices, as well as an increase in the fluid energy to drive the dislodging devices. Typically these dislodging devices are connected to a common manifold thereby making it difficult to concentrate the fluid energy to one particular dislodging device located proximate to a selected part of the container.

SUMMARY OF THE INVENTION

The present invention comprises an apparatus for loosening particulate material from the containing chamber of a container. The apparatus includes a flexible tubular member having an axial passageway wherein a first end portion of the tubular member is disposed within the container, and a second portion of the tubular member is located exterior to the container through an opening in the wall of the container. Apparatus also includes means for providing fluid flow through the axial passageway to cause the first end portion of the tubular member to move in a whip-like manner. Also included are means for mounting the tubular member to the container wherein the mounting means include i) a flexible sealing member connected to the container wall and covering the container passageway wherein the flexible member defines an opening therethrough for engaging the tubular member about the circumference thereof in a frictional sealing fit, and ii) means for connecting the second portion of the tubular member to the container wall.

The apparatus may also include a housing member jacketing the tubular member wherein the tubular member is slideably engaged within the housing member along the longitudinal axis of the housing member to allow axial movement of the tubular member relative to the housing member. The tubular member is movable relative to the housing member between an insertion position wherein the housing member jackets the first end portion substantially along its length, and a retracted wherein the first end portion is exposed substantially along its length.

In an embodiment of the present invention, the apparatus additionally comprises a housing member jacketing the tubular member wherein a portion of the housing member jacketing the first end portion of the tubular member is angled relative to the longitudinal axis of the housing member. The housing member is rotatable about its longitudinal axis to direct the location of the angled portion of the first end portion within the container.

The connecting means may comprise a member attached to the tubular member and projecting outwardly therefrom, as well as a flange member extending outwardly from the container wall wherein the flange member has an arcuate shaped opening therethrough having its axis proximate to the container wall. The flange member slideably engages the projecting member within the arcuate opening to permit pivoting of the tubular member relative to the container wall.

In another embodiment of the present invention there is provided apparatus for dispensing material comprising a container having a wall with an inside surface defining a containing chamber, a wall having an outside surface and a discharge outlet. The container wall has an opening therethrough in communication with the chamber and an area outside of the container. The container has closure means movable between a closed position wherein the closure means obstructs the opening and an open position wherein the opening is unobstructed. The apparatus also includes dispensing means having (i) a flexible tubular member with an axial passageway therethrough and (ii) a pressurized fluid source in fluid communication with the axial passageway. An end portion of the tubular member is disposed through the opening to a location in the container chamber such that when the closure means is moved to the second position, and with the fluid source delivering pressurized fluid through the tubular member, there is imparted to the tubular member end portion a whip-like motion.

In an embodiment of the present invention the closure means may comprise a cover member pivotable between an open position wherein the cover member blocks the container opening and a closed position wherein the cover member is pivoted away from the container opening to a location inside the container.

In another embodiment the closure means may comprise a flexible conduit in communication with the container opening wherein the conduit is located inside the container. The conduit is movable between a closed position wherein the conduit is disposed in a direction substantially perpendicular to the axis of the container opening, and an open position by receiving the tubular member end portion therethrough wherein the conduit is disposed in a direction substantially aligned with axis of the container opening.

In another embodiment the apparatus also comprises a housing member jacketing the tubular member wherein the tubular member is slideable relative to the housing member along its longitudinal axis to allow axial movement of the housing member relative to the tubular member. The axial movement of the housing member relative to the tubular member is between an insertion postion wherein the housing member jackets the end portion substantially along its length, and a retracted position wherein the end portion is exposed substantially along its length.

In another embodiment of the present invention there is provided a flexible tubular member in fluid communication with a fluid source wherein an end portion of the tubular member is located inside the container. A support member jackets the tubular member substantially along its length wherein an end portion of the support member provides lateral support for the tubular member end portion along its longitudinal axis. The support member has less lateral flexibility along its longitudinal axis than the tubular member. The tubular member is slideable within the support member to permit movement of the support member and the tubular member relative to each other along their respective longitudinal axes to expose selective lengths of the tubular member end portion. The embodiment may also include a housing member jacketing the support member wherein the housing member has less lateral flexibility along its longitudinal axis than the support member. The support member is slideable within the housing member to permit movement of the support member relative to the housing member along the longitudinal axis of the housing member to provide support for selected lengths of the support member end portion.

In another embodiment of the present invention there is provided a flexible tubublar member having an axial passageway therethrough wherein an end portion of the tubular member, is located in the container. There is also provided means for rotating the tubular member about its longitudinal axis to cause displacement of the tubular member in a radial direction through 360° of axial rotation. In addition there is provided means for discharging fluid from the axial passageway to cause the end portion of the tubular member to move in a whip-like manner wherein movement of the end portion of the tubular member within the container is defined by the combination of the radial displacement of the tubular member about 360° of axial rotation and the whip-like movement of the tubular member.

The present invention also provides for, in combination, a container having a side wall having an outside surface and an inside surface wherein the inside surface defines a containing chamber for a particulate material that is susceptible to caking in the chamber. At least a portion of the side wall slopes downwardly and inwardly at a downward slant toward a lower discharge opening at a lower end of the container. The side wall has a laterally extending access opening located above the discharge opening. A flexible tubular member has an operating portion extending from the access opening into the chamber. The operating portion of the tubular member has an inactive, position wherein the operating portion extends downwardly, adjacent to the side wall, with an outlet end of the tubular member, being located in a lower part of the chamber. The tubular member has an inlet end adapted to be connected to a source of pressurized fluid, in a manner that pressurized fluid can be directed through the tubular member to cause the operating portion of the tubular member to be in an active mode. With the chamber filled with particulate material and with the discharge opening being open, the outlet end of the tubular member initially loosens material nearer the discharge opening and then loosens material at upper locations by a whip-like movement of the operating portion of the tubular member.

The combination also includes means for mounting the tubular member to the outside surface of the container side wall proximate to the access opening in substantial parallel alignment with the container wall. The mounting means include (i) a bracket member engaged to the container wall about the access opening wherein the bracket member includes an opening laterally therethrough in communication with the access opening to receive the tubular member; and (ii) a flange member integrally attached to the bracket member and extending perpendicularly in an outward direction relative to the container wall wherein the flange member includes an opening laterally therethrough for engaging the tubular member.

The mounting means may also include a flexible member covering the container wall access opening wherein the flexible member is engaged between the container wall and the bracket member. The bracket member includes an opening laterally therethrough in communication with the access opening and the bracket opening for engaging the tubular member about its circumference in a sealing arrangement therewith. The bracket member may also include a flat plate portion having the bracket opening therethrough wherein the flat plate portion is disposed against the flexible member in communication with the container side wall.

The combination may also include a valve means for controlling the flow of pressurized fluid through the tubular member from the fluid source to the operating portion. The valve means is interposed within the tubular member between the fluid source and the operating portion to divide the tubular member into a first segment and a second segment. The first segment is in communication with the fluid source and the second segment is in communication with the container. The valve means includes an annular housing having an inlet end and an outlet end wherein the outlet end is connected to the first segment to receive fluid from the fluid source, and the outlet end is connected to the second segment to discharge fluid to the operating portion. The housing has a longitudinal axis axially aligned with the tubular member at the inlet and outlet respectively. The housing is engaged by the flange member within the flange opening.

The present invention also comprises a method of loosening particulate material, the method comprising the steps of providing a container having a side wall with an outside surface and an inside surface wherein the inside surface defines a containing chamber for a particulate material that is susceptible to caking in the chamber. At least a portion of the side wall slopes downwardly and inwardly at a downward slant toward a lower discharge opening at a lower end of the container. The method also comprises providing a laterally extending access opening through the side wall above the discharge opening, and providing a flexible tubular member having an operating portion extending from the access opening into the chamber. The operating portion of the tubular member has an inactive position wherein the operating portion extends downwardly adjacent to the side wall with an outlet end of the tubular member being located in a lower part of the chamber. In addition the method comprises connecting an inlet of the tubular member to a source of pressurized fluid, in a manner that the pressurized fluid can be directed through the tubular member to cause the operating portion of the tubular member to be in an active mode, so that with the chamber filled with particulate material and with the discharge opening being open, the outlet end of the tubular member initially loosens material nearer the discharge opening and then loosens material at upper locations by reason of a whip like movement of the operating portion of the tubular member.

The method may, in addition, comprise the step of mounting the tubular member to the outside surface of the container side wall proximate to the access opening in substantial parallel alignment with the container wall. In another embodiment there is provided a method of loosening particulate material from a container, the method comprising the step of disposing a first end portion of a flexible tubular member having an axial passageway therethrough within the container. The method also includes disposing a second portion of the tubular member exterior to the container through a passageway in a wall of the container and connecting a flexible sealing member to the container wall to cover the container passageway wherein the flexible sealing member includes a passageway therethrough for receiving the tubular member about its circumference in a sealing arrangement therewith. In addition the method includes causing fluid to flow through the tubular passageway to cause the first end portion of the tubular member to move in a whip-like manner.

In another embodiment of the present invention there is provided a method of loosening particulate material from a container having a wall defining a container chamber, the container wall having an outside surface. The method comprises the step of locating an opening through the wall such that the opening is in fluid communication with the containing chamber and an area outside of the container. The method includes providing closure means movable between a closed positon wherein the closure means obstructs the opening and an open position wherein the opening is unobstructed. Also included is the step of locating a portion of flexible tubular member having an axial passageway therethrough inside the containing chamber through the opening such that the closure means is moved from the closed position to the open position, and then causing the fluid to flow through the tubular member passageway into the containing chamber to impart to the tubular member a whip-like motion. The method also may include locating a plurality of the openings at spaced locations about the container wall and then providing a plurality of the closure means such that there is one closure means per container opening. The method also includes locating the flexible tubular member through one of the container openings into the containing chamber in proximity to a first selected location within the containing chamber.

It is therefore an object of the present invention to provide an apparatus and methods for loosening particulate material contained in a container.

DESCRIPTION OF THE DRAWINGS

This and other objects and advantages of the present invention will become more readily apparent upon reading the following detailed description and upon reference to the attached drawings in which:

FIGS. 5A and 5B are side views of the second embodiment where there is a rigid tubular housing engaging the flexible tubular member wherein the housing is in FIG. 5A in the insertion position and in FIG. 5B in the retracted position;

FIG. 6 is a cutaway view of a container having a plurality of entry/sealing means such as shown in FIG. 4;

FIGS. 7A and 7B are side views similar to FIGS. 5A and 5B of an entry/sealing means of a third embodiment comprising a flexible tubular housing shown in a non-operating closed position in FIG. 7A and in an operating position in FIG. 7B;

Figure 1A:
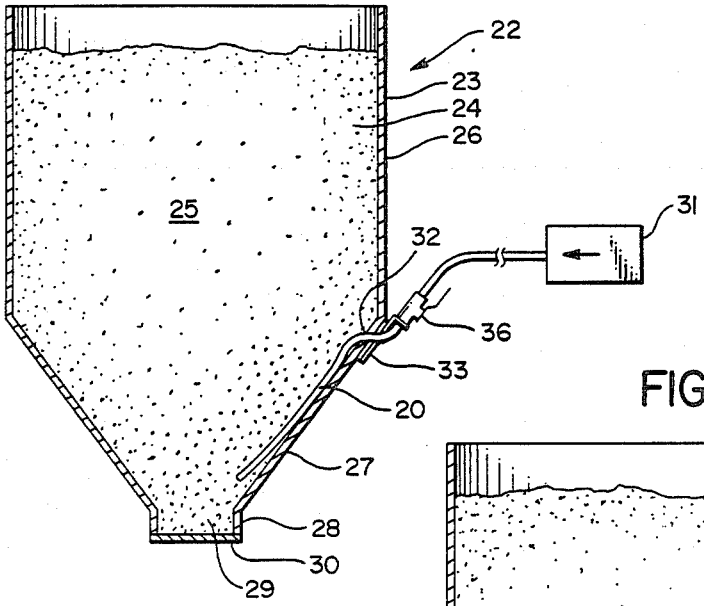
FIGS. 1A, 1B and 1C are sectional views taken along the vertical center axis of a hopper utilizing the present invention with these views illustrating, respectively, the dispersion of material inside a container by flexible tubular member when (i) there is no fluid being conducted through the tubular member, (ii) fluid is initially conducted through the tubular member and (iii) fluid has been conducted through the tubular member for a period of time.

While the present invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents and alternatives falling within the spirit and scope of the invention.

DETAILED DESCRIPTION OF THE INVENTION

Broadly, the present invention comprises a container for storing material which have a tendency to adhere together or to the side of the container. Typically, these materials include, but are not limited to, asbestos, grain, sand and other bulk cargo products. This adhering tendency may be aggravated by the presence of moisture or by compaction of the materials such as when the materials are subjected to vibrational forces similar to those experienced when the materials are transported by motor vehicle or by train. The tendency of the particles to adhere to each other and to the walls of the container may cause "chimney flow" when the contents of the container are discharged through the bottom of the container. When chimney flow occurs, the particles located above the converging portion of the container empty from the container, whereas the particles in proximity to the walls of the container remain inside resulting in incomplete discharge of materials from the container. In addition, "bridging" may occur when the particles have a substantial tendency to adhere to each other. Bridging typically occurs across the inside of the container proximate to the converging portion thereby often preventing the discharge of materials from the container.

Figure 1B:
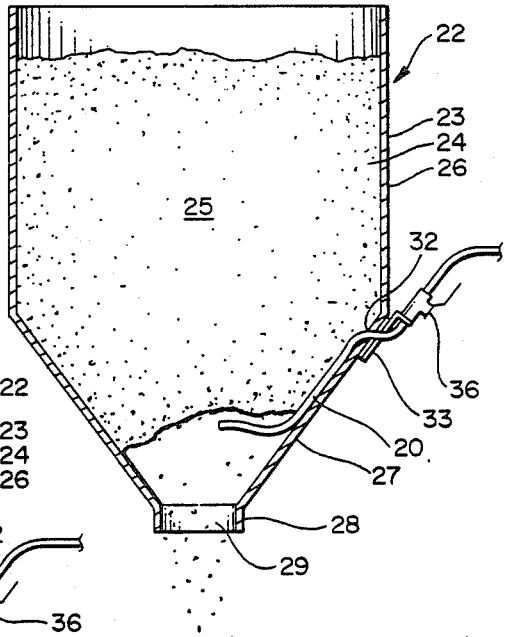
Figure 1C:
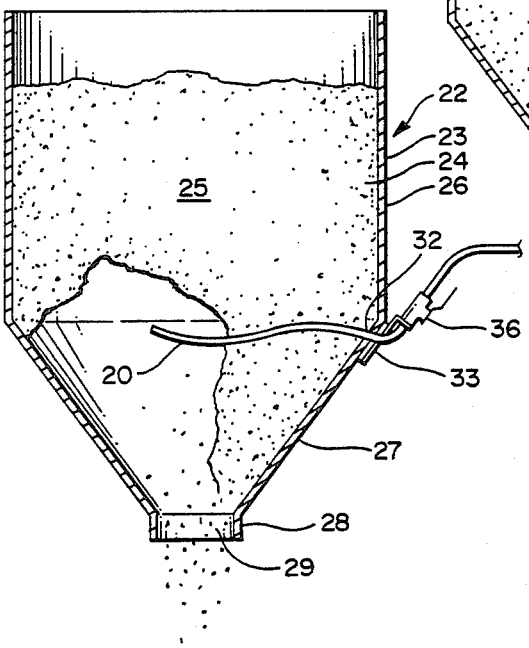

In order to prevent chimney flow and bridging when discharging materials from a container, and to increase the rate of flow from the container by agitating the material therein, there is provided as shown in FIGS. 1A through 1C, a first embodiment of the present invention which comprises a flexible hollow tubular member 20 positioned inside a container 22 having sidewalls 23 defining a containing chamber 24 which is filled with a material 25; the sidewalls 23 comprise an upper vertical sidewall portion 26, a lower downwardly and inwardly converging sidewall portion 27 and a lowermost vertically aligned end portion 28 defining a throat or discharge opening 29. The discharge opening 29 is closed by a removable hatch 30. The convergence of sidewall portion 27 tends to promote the bridging and chimney flow discussed previously. Tubular member 20, made of ethylene-propylene terpolymer (EPDM), is in communication with a source 31 of pressurized fluid, such as air or liquid, located exterior to container 22. The tubular member extends through an access opening 32 formed in an upper part of the converging sidewall portion 27. Tube 20 is secured to container 22 by mounting means 33 located at the access opening 32. Fluid is discharged through tube 20 from fluid source 31 with the flow being controlled by a valve 36. The flow of pressurized fluid through the tube 20 causes the portion of tube 20 inside container 22 to move in a whip-like manner therein.

Referring now to FIG. 1A, there is shown container 22 filled with material 25 such that tubular member 20 which extends downwardly along the sidewall portion 27 is pressed against converging wall portion 27 by the weight of material 25. After discharge hatch 30 is opened in FIG. 1B, material 25 adjacent to throat 29 begins to flow through throat 29 into a receptacle or other device (not shown) therebelow. At the same time fluid is conducted through flexible tubular member 20 causing the lower end of the tubular member 20 to move in a rapid whip-like manner impacting material 25 proximate to the lower end of the converging wall portion 27 thereby agitating material 25 to prevent bridging and compacted accumulations proximate thereto. As material 25 continues to be discharged from container 22, the flow of fluid through flexible member 20 causes the random whip-like movement of flexible member 20 to proceed further upwardly in container 22 as illustrated in FIG. 1C. This general upward expansion of movement improves discharge flow by first reducing any compaction in lower areas of container 22 and then providing further agitation of material 25 in an upward direction.

Figure 2:
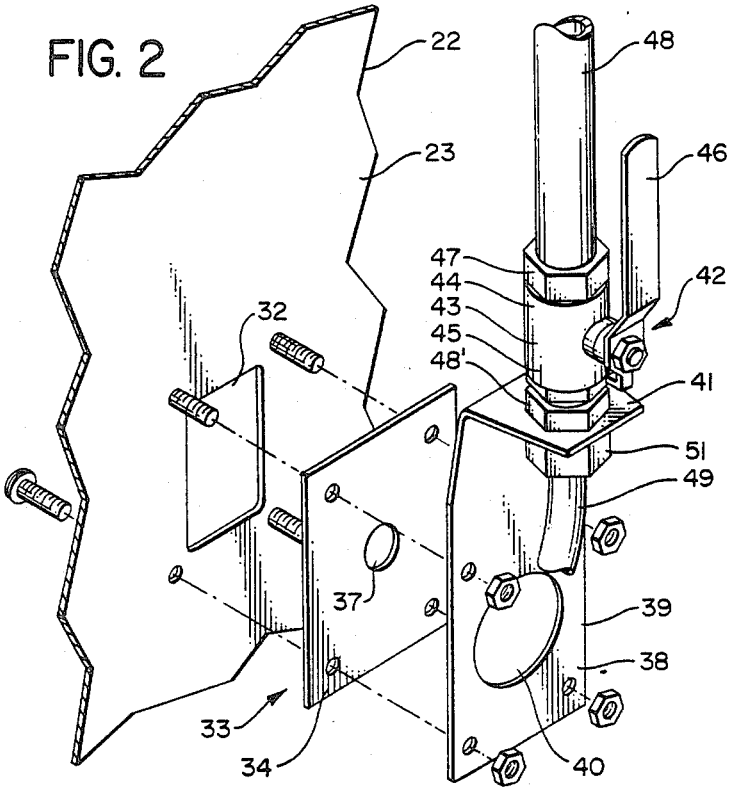
FIG. 2 is an exploded isometric view of a flexible tubular member and flow control of the present invention mounted to the container.

In order to describe the mounting of tubular member 20 to container 22 in greater detail, reference is made to FIG. 2 wherein there is shown a portion of container 22 and mounting means 33. The mounting means 33 comprises a flexible membrane 34 covering access opening 32. Membrane 34 is made of flexible rubber-like material such as polyurethane or ethylene-propylene terpolymer (EPDM). Flexible membrane 34 includes an opening 37 for receiving tubular member 20 in a sealing, frictional fit therewith so as to prevent the escape of material from container 22 through access opening 32. Membrane 34 is sufficiently flexible to allow the rapid whip-like movement of tubular member 20 while maintaining a seal thereabout.

In order to secure tubular member 20 to container 22, a mounting bracket 38 is attached to container 22 sandwiching flexible member 34 therebetween. Mounting bracket 38 includes a flat plate portion 39 which fits against the flexible member 34 and the sidewall portion 27, and the plate portion 39 is formed with a through opening 40 for receiving tubular member 20 therethrough. Passageway 40 is aligned with opening 37 and access opening 32 in order to receive flexible tubular member 20 therethrough.

Figure 3:
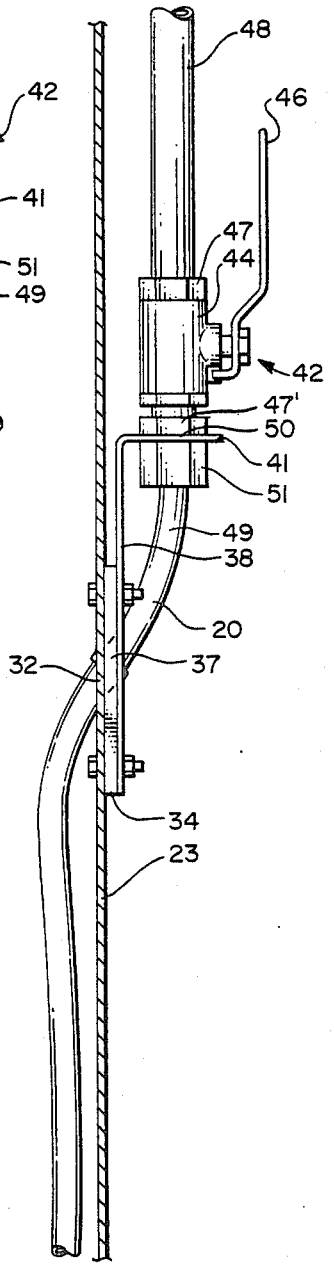
FIG. 3 is a side view of the flexible tubular member and flow control mounted to the container.

Bracket 38 includes a flange 41 integrally attached to the upper edge of the plate portion 39 so as to extend outwardly perpendicularly to the plate portion 39. Mounted to the flange 41 is a flow control valve indicated at 42 for regulating the flow of fluid through tubular member 20. Valve 41 includes an annular housing 43 having an inlet end 44, an outlet end 45 and a valve control handle 46. Inlet end 44 is connected by a clamping means 47 to a segment 48 of tubular member 20 leading to pressurized fluid source 31. Outlet end 45 is connected by a clamping means 48' to a segment 49 of tubular member 20 leading to the inside of container 22. Flange 41 includes an opening 50 laterally therethrough for receiving tubular segment 49. Flange 41 is engaged at opposite surfaces thereof by clamping means 47' and a nut 51 to secure valve 44 to flange 41 thereabove. Activation of flow control valve 44 to the "on" position causes fluid to be discharged through tubular member 20 into container 22 resulting in the movement of tubular member 20 inside container 22 from an "inactivated" configuration wherein tubular member 20 is located proximate to container wall portion 27 in substantial parallel alignment therewith, to an "activated" configuration wherein tubular member 20 is moved in a rapid whip-like manner. The longitudinal axis of flow control valve 42 is mounted proximate to container wall 23 in substantial parallel alignment therewith as shown in FIG. 3 such that flexible tubular member 20 is disposed within openings 32, 37 and 40 at an oblique angle relative to container wall portion 26 to reduce the bending of tubular member 20 through access opening 32 when tubular member 20 is in an "inactivated" configuration in order to alleviate any crimping of tubular member 20. The openings 32 and 40 are made substantially larger than the cross section of the tubular member to permit this oblique alignment of the tubular member 20. Flow control valve 44 is manually actuated by handle 46 to regulate the flow of fluid from fluid source 31 into container 22.

The present invention has been described in reference to a single tubular member 20 mounted at a single location to the container 22. As discussed previously, it is sometimes desirable to utilize a tubular member 20 which can be inserted by the operator at various selected locations of container 22. This is accomplished by a second embodiment of the present invention which will now be described with reference to FIGS. 4, 5A and 5B. Components of this second embodiment which correspond to the components of the first embodiment will be given like numerical designations, with an "a" suffix distinguishing those of the second embodiment.

Figure 4:
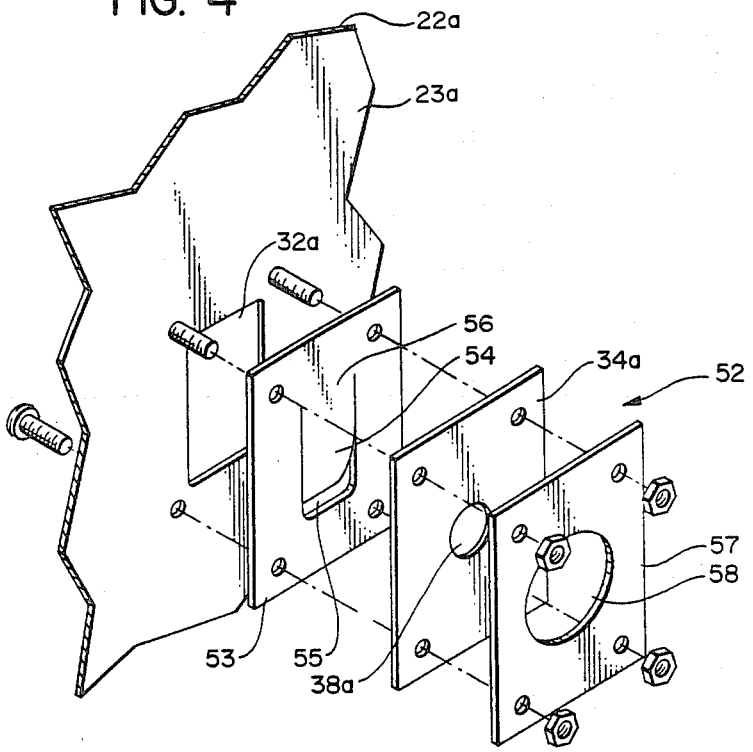
FIG. 4 is an exploded isometric view of a container entry/sealing means of a second embodiment of the present invention and comprising a one way flap member.

Referring now to FIG. 4 there is shown a portion of container 22*a* including an access opening 32*a* therethrough. Opening 32*a* is covered by an entry/sealing means generally indicated at 52 comprising a flexible member 53 engaged to container 22*a* so as to cover opening 32*a*. Flexible member 53 has a central portion thereof cut along three sides to form a flap 54 and a through opening 55. Flap 54 is movable between a "closed" position wherein flap 54 covers opening 55, and an "open" position wherein flap 54 is swung away from opening 55 about a hinge line so as to extend through passageway 32*a* and into container 22*a*. Flexible member 53 is made of a material such as polyurethane or EPDM. Flexible membrane 34*a*, including an opening 38*a* therethrough, is attached to container 22*a* to sandwich flexible member 53 therebetween such that opening 38*a* is aligned with opening 55. A mounting bracket 57, including an opening 58, is attached to container 22*a* sandwiching flexible membrane 34*a* between flexible member 53 and mounting bracket 57 such that opening 58 is aligned with openings 38*a*, 55 and 32*a*. It should be appreciated that flexible member 53 comprises a one way valve means which opens in an inward direction into container 22*a*, but is prevented from moving in an outward direction beyond the plane of flexible member 53 by flexible membrane 34*a* to prevent the escape of material from container 22*a* when flap 54 covers passageway 55 in a "closed" position.

In conjunction with entry/sealing means 52, there is shown in FIG. 5A a flexible tubular member 20*a* slideably enclosed in an elongate relatively rigid tubular housing 60 having a longitudinal axis substantially aligned with that of the tubular member 20. In FIG. 5A the housing 60 is shown in a position inserted through openings 58, 38*a*, 55 and 32*a* of entry/sealing means 52 and into container 22*a*. Opening 38*a* of flexible member 34*a* is sized to engage housing 60 about the circumference thereof in an elastic tight fit, while the openings 32*a*, 55 and 58 are substantially larger than the cross section of the tubular housing 60. The housing 60 is sufficiently rigid along its longitudinal axis so that it can be inserted into entry/sealing means 52 to force flap 54 away from opening 34*a* and to displace any material 25*a* in container 22*a* thereby permitting insertion of tubular member 20*a* into the chamber 24 of container 22*a* when container 22*a* is sufficiently full of material 25*a* to block passageway 32*a*. Once housing 60, with the tubular member 20*a* positioned therein, has been inserted through entry/sealing means 52 into container 22*a*, housing 60 is moved to a "retracted" position shown in FIG. 5B by manually sliding housing 60 in an axial direction relative to the longitudinal axis of tubular member 20*a* until the forward end of the housing 60 extends only a short distance beyond the flexible member 34*a*. Thus in the embodiment shown in FIGS. 5A and 5B, housing 60 is engaged by flexible member 34*a* and supported by an operator (not shown) to hold a portion of tubular member 20*a* stable relative to container 22*a* when tubular member 20*a* is activated by fluid from a fluid source flowing therethrough into container 22*a*. Utilizing the operator to support housing 60 together with the support provided by flexible member 34*a* allows for rapid insertion of housing into container 22*a*, retraction of housing 60 and activation of tubular member 20*a*.

Referring now to FIG. 6 there is shown a plurality of entry/sealing means 52 at various locations of container wall 23*a*. An operator attempting to empty container 22*a* may discover a portion of material 25*a* adhering to a section of container 22*a*. By inserting housing 60 through a selected entry/sealing means 52 that is in proximity to the adhering material 25*a* at the upper portion of container 22*a*, for example, then retracting housing 60 and activating fluid source 31, the adhering material 25*a* is impacted and dispersed by flexible tubular member 20*a* at the completion of the material loosening operation, the operator can remove housing 60 from entry/sealing means 52 and return housing 60/tubular member 20*a* to a storage location away from container 22*a*.

Figure 7B:
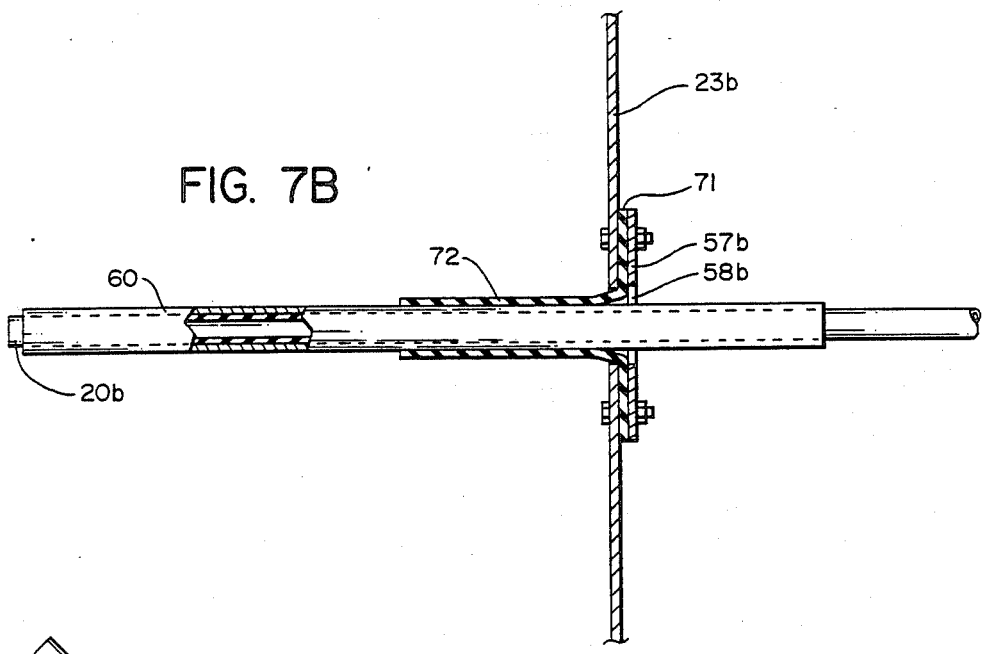

A third embodiment of the present invention is illustrated in FIGS. 7A and 7B. Components of the third embodiment which are similar to components of the first or second embodiment will be given like numerical designations, with "b" suffix distinguishing those of the third embodiment.

In the third embodiment of the present invention, there is shown an entry/sealing member indicated at 70 comprising a flexible flange 71 integrally connected to a flexible tubular housing 72; flange 71 is attached to container 22*b* by mounting bracket 57*b*. Flexible tubular housing 72 includes a passageway 74 therethrough in fluid communication with opening 32*b* of container 22*b* and opening 58*b* of mounting bracket 57*b*. Flexible housing 72 comprises a flexible material such as polyurethane which hangs vertically from container wall 23*b* when container 22*b* is empty or when container 22*b* is being filled and flexible housing 72 is forced downward due to the flow of material into container 22*b*. The downward directed position of flexible housing 72 illustrated in FIG. 7A comprises a "closed" position wherein passageway 32*b* is closed to prevent the escape of material therethrough. When housing 60 is inserted into openings 32*b* 74 as illustrated in FIG. 7B, the inward insertion force of housing 60 causes flexible member 72 to axially align with the longitudinal axis of housing 60 to permit entry of housing 60 through passageway 74 and into container 22*b*. Housing 60 is then moved into the "retracted" position (FIG. 5B) to prepare for receiving fluid through tubular member 20*b*.

Figure 8:
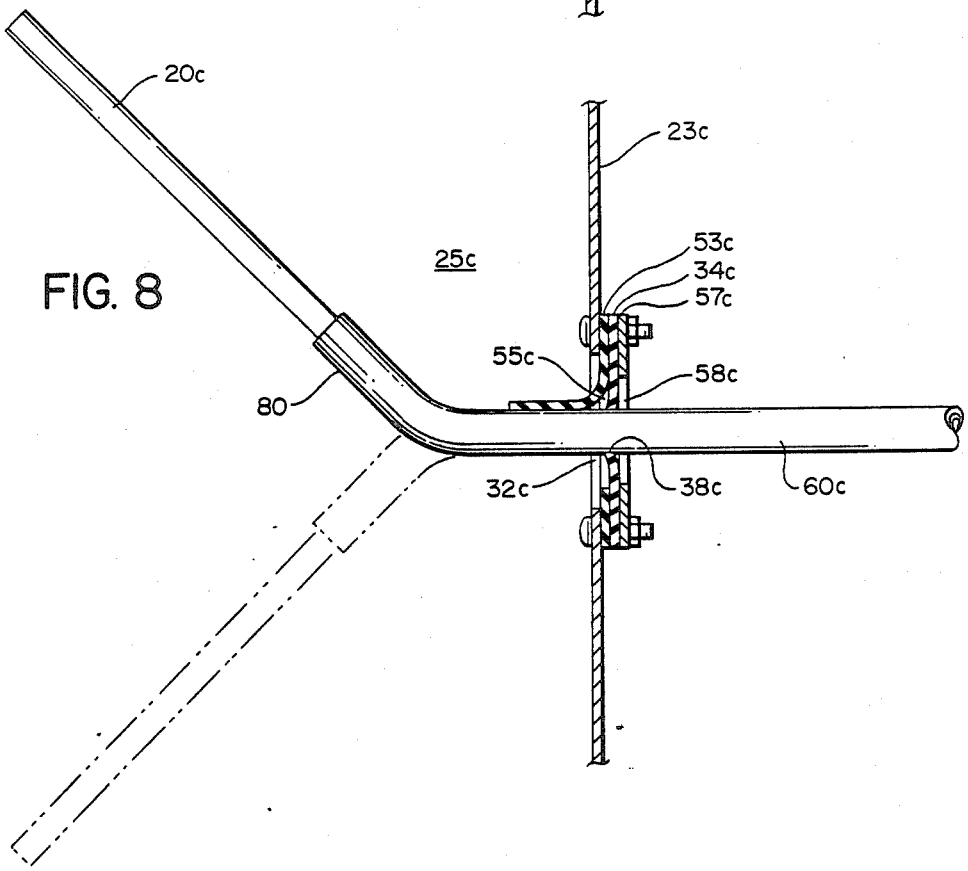
FIG. 8 is a side view similar to FIG. 5B of a fourth embodiment where there is a housing having an angular portion in proximity to one end thereof.

A fourth embodiment of the present invention is illustrated in FIG. 8. Components of this fourth embodiment which are similar to components of the previous embodiments will be given like numerical designations, with "c" suffix distinguishing those of the fifth embodiments.

In the fourth embodiment of the present invention, housing 60*c* includes an angled end portion 80 integrally attached thereto and extending outwardly at an angle of about 45° from the longitudinal axis of the housing 60*c*; housing 60*c* disposed through passageways 58*c*, 38*c*, 55*c*, 32*c* such that angled portion 80 is located inside container 22*c*. Housing 60*a* is rotatably engaged within flexible membrane 34*c* such that rotation of housing 60*c* about the longitudinal axis thereof displaces angled portion 80, as well as tubular member 20*c*, at various locations within container 22*c*. An operator may orient angled portion 80 tubular member 20*c* proximate to a selected portion of material 25*c* within container 22*c* by rotation of housing 60.

Figure 9:
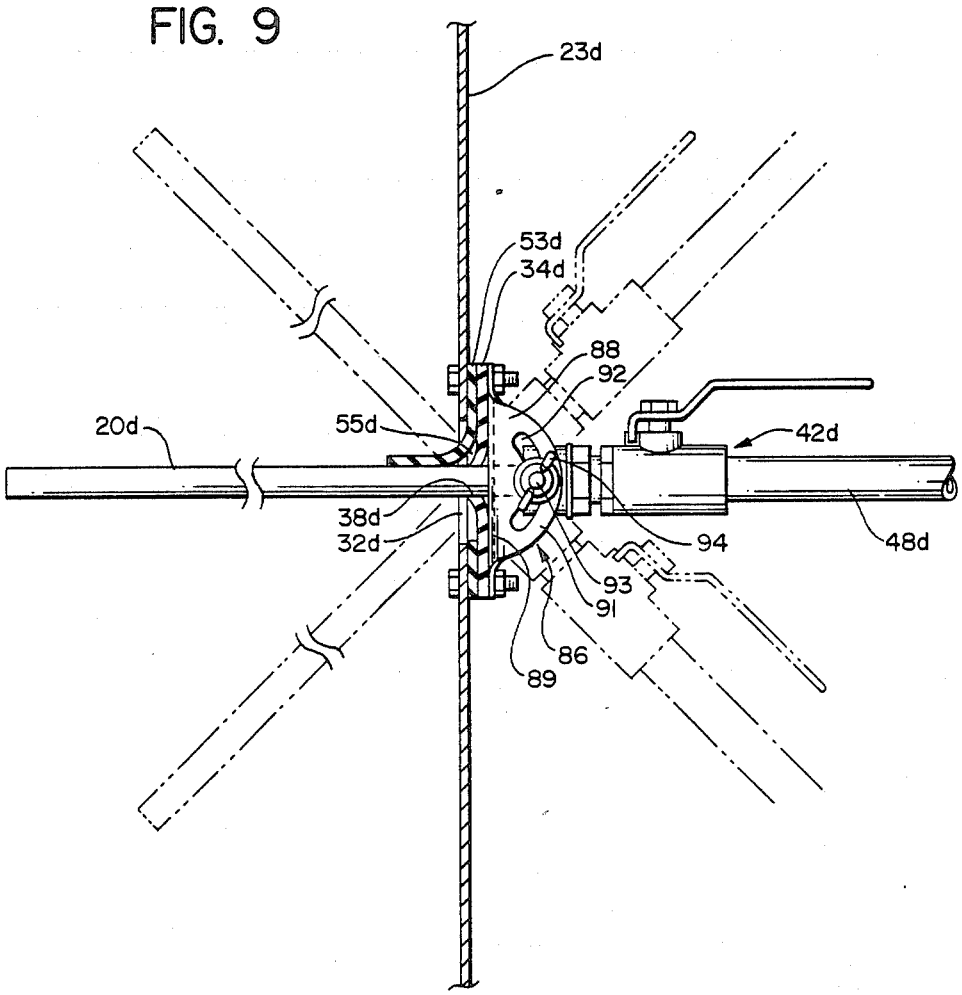
FIG. 9 is a side view similar to FIG. 8 of a fifth embodiment where the tubular member and flow control valve are pivotally mounted to the container to allow repositioning of the tubular member within the container.
Figure 10:
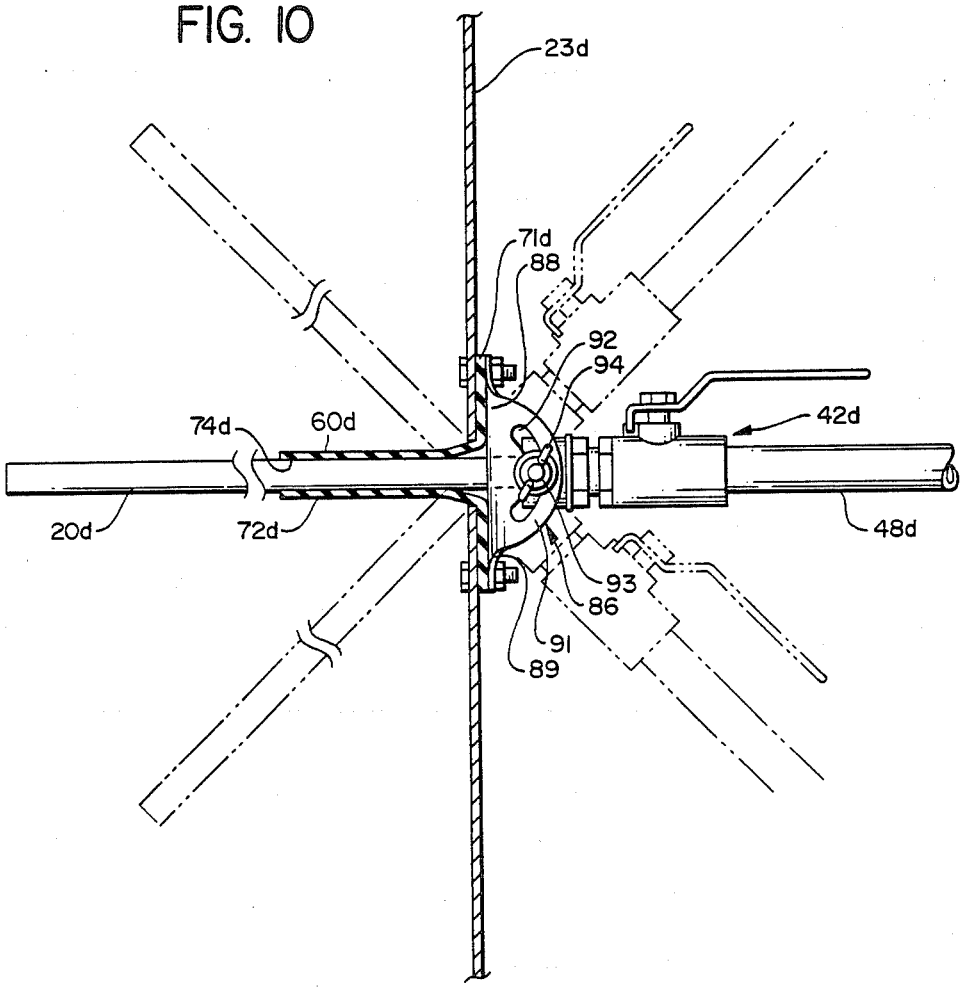
FIG. 10 is a side view similar to FIG. 7B of a fifth embodiment where the tubular member and flow control valve are pivotally mounted to the container to allow repositioning of the tubular member within the container.

A fifth embodiment of the present invention is illustrated in FIGS. 9 and 10. Components of this fifth embodiment which are similar to components of the previous embodiments will be given like numerical designations, with "d" suffix distinguishing those of the fifth embodiment.

Referring first to FIG. 9, when it is desirable to attach flow control valve 42*d*, to container 22*d* a certain amount of directional control of tubular member 20*d* within container 22*d* is provided by a swivel mounting means, indicated at 86, comprising a mounting bracket 88 having a flat portion 89 mounted parallel to container wall 23*d* sandwiching flexible membrane 34*d* therebetween. Flat portion 89 includes an opening centrally disposed therethrough having a cross sectional area larger than the cross sectional area of openings 38*d*, 32*d* respectively. Mounting bracket 88 also includes an integral flange 91 extending outwardly from container wall 23*d* perpendicular thereto and located in a vertical plane. Flange 91 includes an arcuate shaped slot 92; the axis of slot 92 located proximate to container wall 23*d*. Slot 92 is sized to receive therethrough a member 93 projecting from flow control valve 42*d* and engaged to flange 91 by an adjustable wing nut 94. Tubular member 20*d* may be pivoted relative to container 22*d* through a vertical plane as shown in FIG. 9 by unscrewing wing nut 94 to allow projecting member 93 to move within slot 92.

An alternate embodiment for mounting swivel mounting means 86 is illustrated in FIG. 10 wherein flexible tubular housing 60*d* is shown engaging tubular member 20*d* within passageway 74*d* of tubular housing 60*d*; flexible flange 71*d* is sandwiched between swivel mounting means 86 and container wall 23*d*.

Figure 11:
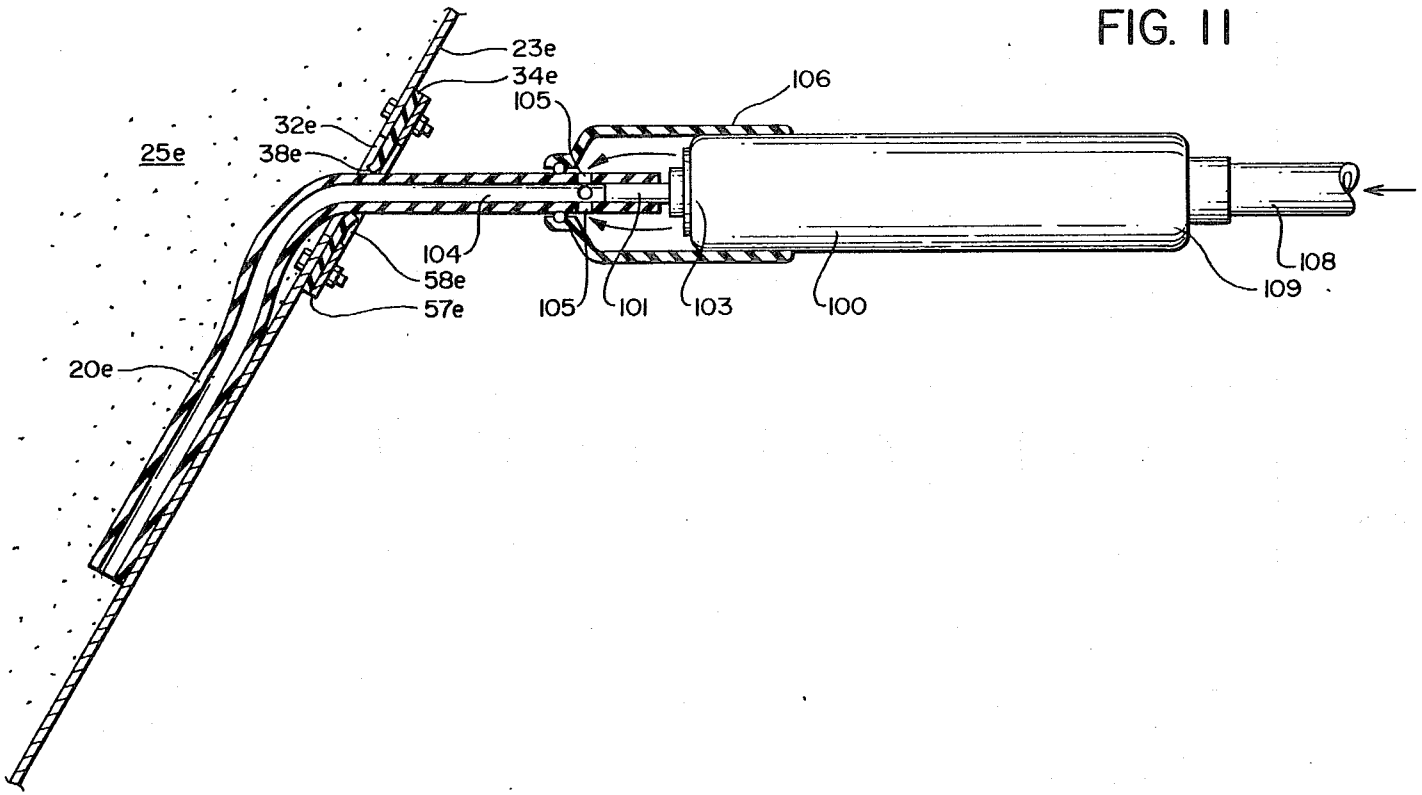
FIG. 11 is a side view of a sixth embodiment where the tubular member is rotatably engaged to a rotary motor.

A sixth embodiment of the present invention is illustrated in FIG. 11. Components of this sixth embodiment which are similar to components of the previous embodiments will be given like numerical designations with "e" suffix distinguishing those of the sixth embodiment.

In the sixth embodiment of the present invention, there is shown flexible tubular member 20*e* engaged to a drive motor 100 at a rotatable drive shaft 101 located at distal end 103 of an air driven motor 100. Tubular member 20*e* has a main passageway 104 through the axial center thereof, and a plurality of radial passageways 105 through the wall of tubular member 20*e* in proximity to shaft 101. A housing 106 encloses shaft 101, as well as a portion of tubular member 20*e*, including radial passageways 105, and motor 100 at distal end 103 in order to direct air, which enters motor 100 via flexible conduit 108 at proximal end 109 thereof and which is discharged from distal end 103, to pass through passageway 104. The air passes throughout the passageways 105 and out the end of the tubular member 20*e*.

It can be appreciated that rotation of tubular member 20*e* about the longitudinal axis thereof at a sufficient rotational velocity causes tubular member 20*e* to be displaced radially through 360° of rotation from an axial centerline coinciding with the axis of rotation of the shaft 101; the amount and configuration of radial displacement a function, among other things, of the rotational velocity of tubular member 20*e*, the airflow through tubular member 20*e*, and the flexibility of tubular member 20*e* along the longitudinal axis thereof. The combination of the increased radial displacement provided by the rotation of tubular member 20*e* in combination with the whip-like motion of tubular member 20*e* provided by air expelled from passageway 104 causes the whip-like movement of tubular member 20*e* to travel through a larger volume of container 22*e*. In addition, the discharge of air from tubular rember 20*e* increases the dispersion of material 25*e*. Air driven motor 100 may be utilized as a hand-held portable device to allow positioning tubular member 20*e* at selected locations within container 22*e* as descrbed in reference to FIG. 6; or motor 100 may be secured to container 22*e* in a well known manner.

Figure 12:
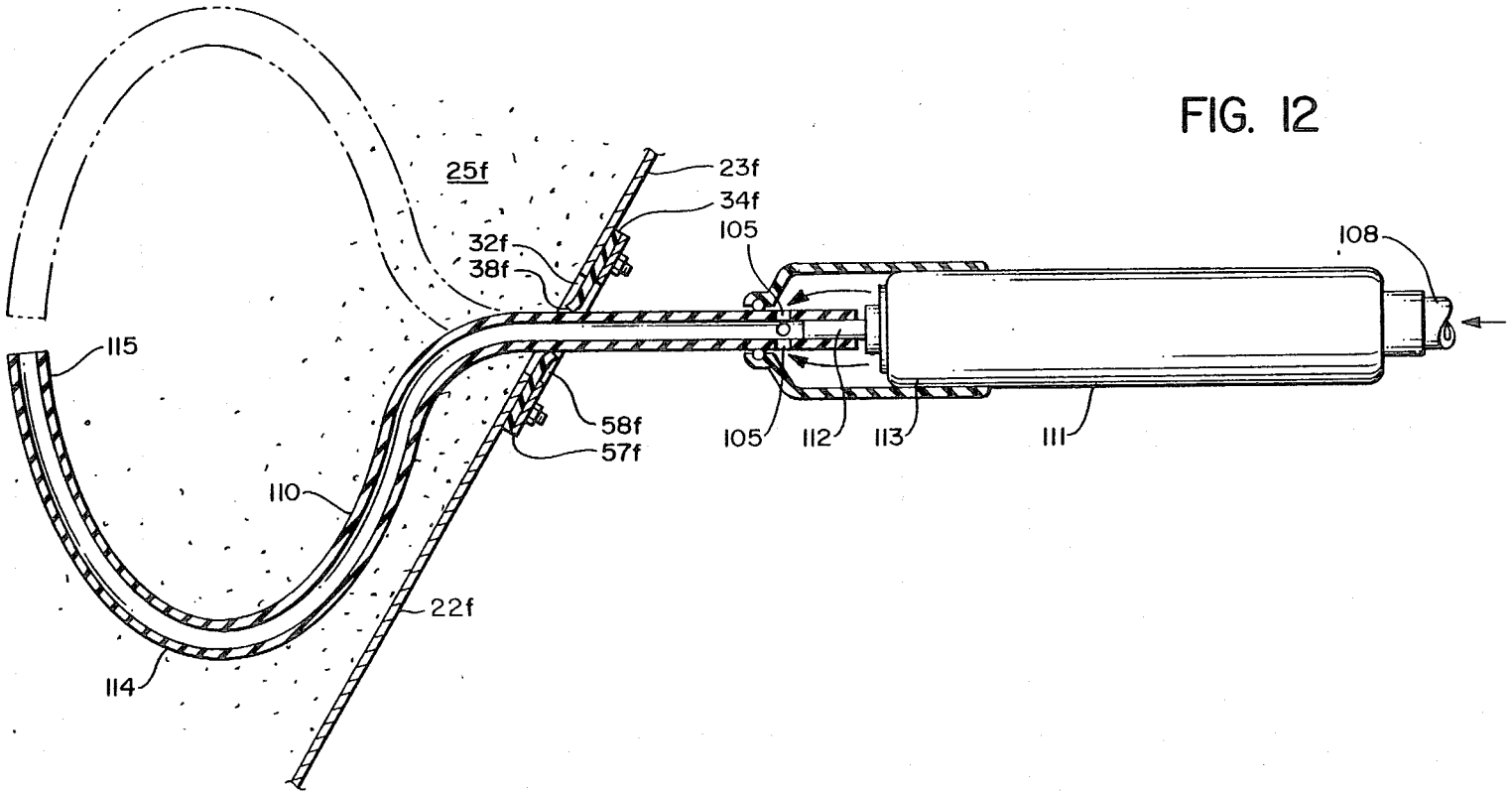
FIG. 12 is a side view of a seventh embodiment where there is a solid flexible member rotatably engaged to a rotary motor.

A seventh embodiment of the present invention is illustrated in FIG. 12. Components of this seventh embodiment which are similar to components of the previous embodiments will be given like numerical designations with "f" suffix distinguishing those of the seventh embodiment.

In the seventh embodiment of the present invention there is shown a flexible member 110 engaged to a rotary motor 111 at a rotatable drive shaft 112 located at distal end 113 of motor 111. Flexible member 110 comprises a solid mass of flexible material. Motor 111 may comprise an electrically powered, hydraulically powered, air driven motor or the like. It can be appreciated that rotation of flexible member 110 about the longitudinal axis thereof at a sufficient rotational velocity causes flexible member 110 to be displaced radially from an axial centerline coinciding with the axis of rotation of shaft 112 through 360° of axial rotation; the amount of radial displacement a function, among other things, of the rotational velocity of flexible member 110 and the flexibility of flexible member 110 along the longitudinal axis thereof. The radial displacement of flexible member 110 provided by the rotational force imparted thereto by motor 111 causes flexible member 110 to travel through container 22*f* impacting material 25*f* therein to dislodge material 25*f* from container 22*f*. Rotation of flexible member 110 by motor 111 imparts to flexible member 110 a parabolic-like pattern shown in FIG. 12 depending upon the flexibility, mass and length of flexible member 110 between tip 115 and container wall 23*f*. A portion 114 of flexible member 110 between shaft 112 and a tip 115 of flexible member 110 is displaced in an outward radial direction relative to an axial centerline coinciding with the axis of rotation of shaft 112 such that the point of maximum radial displacement 116 of flexible member 110 defines the vertex of the parabolic pattern. It should be appreciated that the movement of flexible member 110 within container 22*f* is not random, but rather is defined by the parabolic-like pattern. This regular pattern of movement of flexible member 110 allows an operator to impact selected target areas of material 25*f* in container 22*f*.

Figure 13:
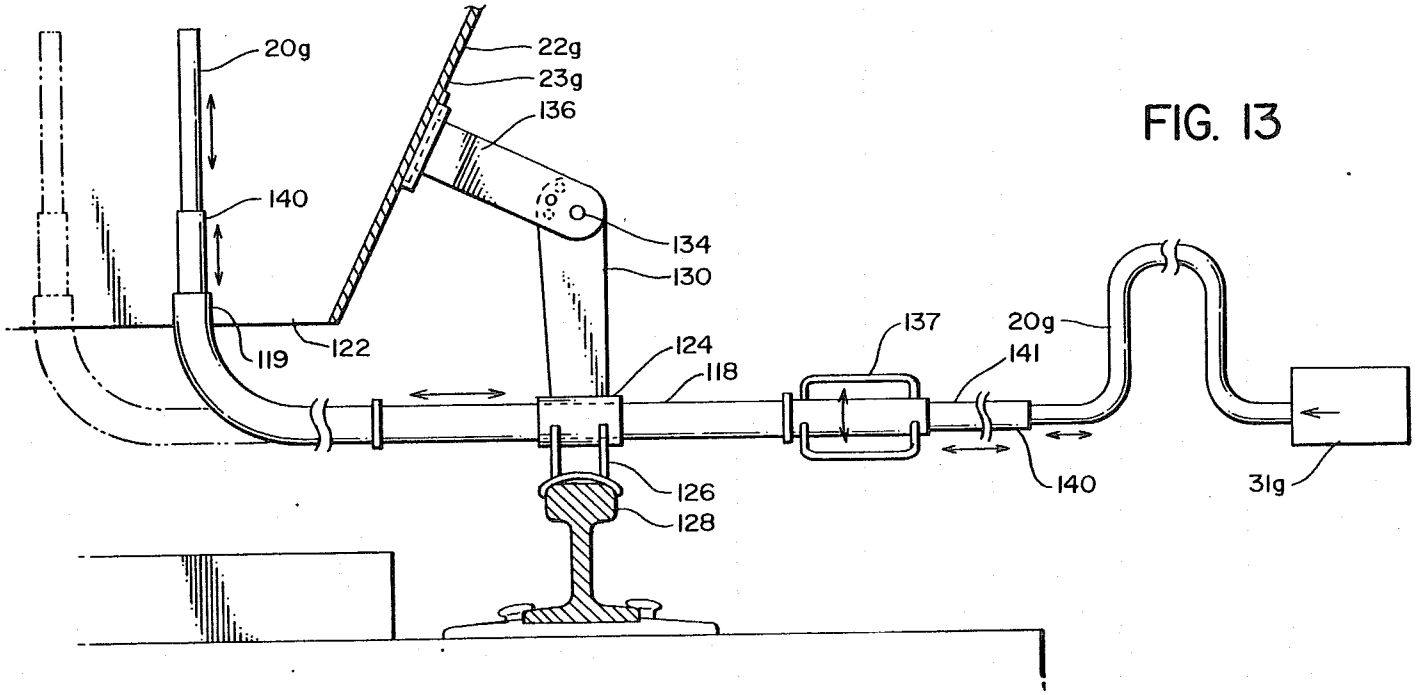
FIG. 13 is a side view of an eighth embodiment where there is a tubular housing member having a semi-rigid tubular member slideably engaged therein, and a flexible tubular member slideably engaged within the semi-rigid tubular member.

An eighth embodiment of the present invention is illustrated in FIG. 13. Components of this eighth embodiment which are similar to components of the previous embodiments will be given like numerical designations with "g" suffix distinguishing those of the eighth embodiment.

In the eighth embodiment of the present invention, there is shown apparatus for accessing a container 22*g* (which is part of a railway freight car)through the bottom thereof including a tubular housing or sleeve 118 having an end portion 119 at the distal end thereof terminating inside container 22*g* in an upward vertical direction through discharge outlet 122 at the bottom thereof; end portion 119 curved approximately 90° relative to the longitudinal axis of housing 118 and positioned within container 22*g* after container doors (not shown) covering discharge outlet 122 have been opened. Housing 118 is rotatably and slideably engaged in the horizontal plane within a mounting sleeve 124 which is supported by a support stand 126 depending vertically therefrom to be mounted to a rail 128. Sleeve 124 is also supported by a support arm 130 disposed vertically thereabove which is pivotally connected, at a pivot connector 134 to a support arm 136 affixed to container wall 23*g*. Tubular housing 118 includes a handle 137 to reposition housing 118 in an axial direction or to rotate housing 118 about its longitudinal axis.

Slideably engaged within housing 118 is a semi-rigid tubular support 140 extending beyond tubular housing 118 at both ends thereof. Slideably engaged within tubular support 140 is a flexible tubular, or impacting, member 20*g* extending beyond tubular support 140 at both ends thereof. Tubular support member 140, however, is sufficiently rigid along the longitudinal axis thereof to provide support to tubular member 20*g*, i.e., support member 140 is more rigid than tubular member 20*g*; typically support member 140 comprises a helical metal spring or the like. Support member 140 is sufficiently flexible, however, along the longitudinal axis thereof to permit lateral movement of support member 140 and tubular member 20*g* when fluid is discharged from tubular member 20*g*.

In order to reposition tubular housing 118 relative to container 22*g*, tubular housing 118 is movable in an axial direction by handle 137 causing tubular housing 118 to move axially within sleeve 124 and causing support arm 130 to pivot relative to support arm 136 about pivot connector 134.

In order to access various selected areas inside of container 22*g*, the length of flexible tubular member 20*g* within container 22*g* is varied by moving support member 140 in an axial direction relative to tubular member 20*g* at an exposed end 141 of support member 140 proximate to handle 137. In order to provide support for flexible tubular member 20*g* in a vertical direction as the length of flexible tubular member 20*g* within container 22*g* is increased in a vertical direction, the length of tubular support 140 is also increased in a vertical direction within container 22*g* by moving tubular member 140 at exposed end 141 thereof so as to enclose a larger portion of flexible tubular member 20*g*. When the length of flexible tubular member 20*g* within container 22*g* is decreased, the length of tubular support 140 therein is also decreased so that the desired length of flexible tubular member 20*g* remains exposed within container 22*g*. In addition, the 90° bend wherein housing 118 joins end portion 119 tends to impart to the portion of tubular member 20*g* located therein a "bended" configuration. Support member 140 counteracts this bended disposition of tubular member 20*g* whenever the bended portion of tubular member 20*g* is moved inside container 22*g*.

In order to reposition flexible tubular member 20*g*, handle 136 is rotated about the longitudinal axis of housing 118 to reposition housing 118 and flexible tube 20*g* between a "stowed" position wherein tubular member 20*g* is positioned in a vertically downward direction, and an "operable" position wherein tubular member 20*g* is positioned inside container 22*h*. Rotation of housing 118 by handle 137 also allows repositioning of tubular member 20*g* at various locations within container 22*g*. A fluid source 31*g* provides a source of fluid through tubular member 20*g* which is discharged into container 22*g* to cause tubular member 22*g* to move in a whip like manner.

Figure 14:
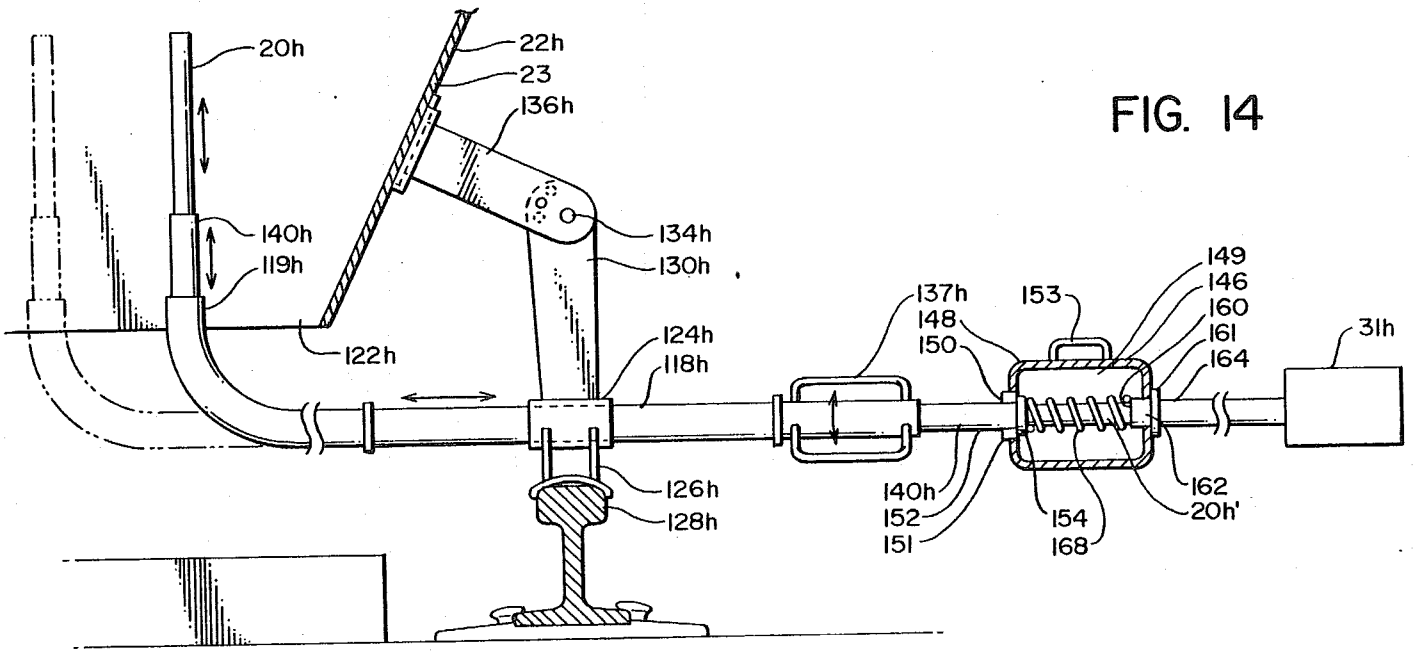
FIG. 14 is a side view of a ninth embodiment similar to FIG. 13 of an eighth embodiment where there is shown a tubular housing member having semi-rigid tubular member slideably engaged therein, a flexible tubular member slideably engaged within the semi-rigid tubular member and means for repositioning the flexible tubular member and semi-rigid tubular member.

A ninth embodiment of the present invention is illustrated in FIG. 14. Components of this ninth emodiment which are similar to components of the previous embodiments will be given like numerical designations with "h" suffix distinguishing those of the ninth embodiment.

In the ninth embodiment of the present invention, there is shown apparatus for accessing a container 22*h* through the bottom thereof, including means 146 for imparting axial movement to reposition flexible tubular member 20*h* and support member 140*h* in an axial direction within container 22*h*. Repositioning means 146 includes a housing 148 having an interior space 149, and having an opening 150 and an annular collar 151 therearound for slideably engaging support member 140*h* at an exposed end 152 thereof exterior to container 22*g*. Collar 151 is slideably engaged to support member 140*h* to permit axial movement of housing 148 along support member 140*h* utilizing a handle 153 attached to housing 148. Support member 140*h* includes an annular lip 154 projecting outwardly therefrom and located within interior space 149 for restraining axial movement of housing 148 beyond the end of support member 140*h* upon engaging collar 151. Extending axially beyond support member 140*h* at exposed end 152 is a segment 20*h'* of tubular member 20*h* which is located within interior space 149, including a distal end 160 which is engaged to a tubular connector 162 attached to housing 148 at end 161 thereof such that axial movement of housing 148 causes axial movement of tubular member 20*h* therewith. Tubular connector 162 is in fluid communication with tubular member 20*h'* and fluid source 31*h* through a conduit 164. In order to reposition support member 140*h* there is provided a compression spring 168 disposed circumferentially about tubular segment 20*h'* and in contact at opposite ends thereof with lip 154 and tubular connector 162, respectively. Axial movement of housing 148 in a left direction when viewing FIG. 14, causes upward movement of tubular member 20*h* within container 22*h* as well as compression of spring 168 which reacts thereto to cause axial movement of support member 140*h* in an upward direction within container 22*h* to provide longitudinal support to tubular member 20*h*.

What is claimed is:

1. Apparatus for loosening particulate material contained in a container, said apparatus comprising:

a. a flexible tubular member in fluid communication with a fluid source, a first end portion of said flexible tubular member located inside said container, second end portion of said flexible tubular member located outside of said container;

b. a support member jacketing said flexible tubular member substantially along the length thereof, a first end portion of said support member providing lateral support for said flexible tubular member first end portion along the longitudinal axis thereof, said support member having lateral flexibility along the longitudinal axis thereof which is less than that of said flexible tubular member, said flexible tubular member slidable within said support member to permit axial movement of said support member and said flexible tubular member relative to each other along the longitudinal axes thereof to expose selected lengths of said flexible tubular member first end portion; and c. a sleeve member jacketing said support member, said sleeve member having less lateral flexibility along the longitudinal axis thereof than said support member, said support member slidable within said sleeve member to permit axial movement of said support member relative to said sleeve member along the longitudinal axis of said sleeve member to provide support for selected lengths of said support member first end portion.

2. The apparatus as recited in claim 1 wherein a portion of said sleeve member is angled relative to the longitudinal axis thereof, said angled portion located within said container, said sleeve member rotatable about the longitudinal axis thereof to direct the location of said angled poriton in combination with said support member first end portion and said flexible tubular member first end portion in said container.

3. The apparatus as recited in claim 1 additionally comprising means for repositioning said flexible tubular member and said support member, said repositioning means including:

a. a housing member including a wall thereof having an outside surface, and an inside surface defining a chamber, said wall including a lateral opening therethrough for receiving a second end portion of said support member located outside of said container in axial slideable engagement with said wall, said second end portion of said flexible tubular member extending axially beyond said second end portion of said support member and engaged to said housing member at said inside surface; and b. a spring member disposed about the circumference of said second end portion of said flexible tubular member, said spring member including a first end and a second end, said spring member engaging said support member at said first end and engaging the inside surface of said housing member at said second end.

4. A method for loosening particulate material contained in a container, the method comprising the steps of:

a. providing a flexible tubular member in fluid communication with a fluid source;

b. locating an end portion of the flexible tubular member inside the container;

c. jacketing the flexible tubular member with a support member substantially along the length thereof, the support member having flexibility along the longitudinal axis thereof which is less than that of the flexible tubular member, an end portion of the support member providing lateral support for the flexible tubular member end portion along the longitudinal axis thereof;

d. jacketing the support member with a sleeve member which has less lateral flexibility along the longitudinal axis thereof than the support member; and e. sliding the flexible tubular member relative to the support member along the longitudinal axis thereof to expose selected lengths of the flexible tubular member end portion and sliding the support member within the sleeve member to permit axial movement of the support member relative to the sleeve member along the longitudinal axis of the sleeve member to provide support for selected lengths of the support member end portion.

5. In combination with a container, apparatus for loosening compacted particulate material within the container to allow the loosened particulate material to gravity flow out a lower opening in the container, said apparatus comprising:

a. an elongated impacting member which has an axial passageway and a flexible first end segment;

b. an elongated support member which has a first end segment which jackets said impacting member first end segment in a manner that a portion of said impacting member first end segment extends beyond said support member first end segment, said support member first end segment being flexible to a degree which is less than that of said impacting member first end segment to provide axial support for said impacting member first end segment;

c. an elongated sleeve member which has a first end segment which is less flexible than said support member first end segment and which jackets said support member first end segment in a manner that a portion of said support member first end segement extends beyond said sleeve member first end segment, said sleeve member providing axial support for said support member first end segment;

d. said sleeve member first end segement being movable between a first position where said extended portion of said impacting member is located outside of said container, and a second position where said extended portion of said impacting member is supported in an upward direction through said container lower opening and within said container; and e. means, in communication with said impacting member, for providing fluid flow through said impacting member passageway to impart to the upwardly supported extended portions of said impacting member and said support member a whip-like motion to cause said impacting member to impact compacted particulate material within said container causing said compact material to become loosened.

6. The apparatus as set forth in claim 5 wherein:

a. said impacting member is movable axially within said support member to locate said extended portion of said impacting member at selected elevations within said container; and b. said support member is movable axially relative to said impacting member and said sleeve member so that said first end segment of said sleeve member jackets said support member first end segment in a manner to support said extended portion of said impacting member at said selected elevations.

7. The apparatus as set forth in claim 6 wherein:

a. said first end segment of said sleeve member is generally perpendicular to a remaining portion of said sleeve member; and b. said remaining portion is supported in a generally horizontal plane and in a manner so that said remaining portion is rotatable about its longitudinal axis to move said first end segment of said sleeve member between said first and second position where said first end portion of said sleeve member is upwardly directed.

8. The apparatus as set forth in claim 7 wherein said sleeve member is axially rotatably supported in mounting a sleeve which in turn is suported at location below the level of the container lower opening.

9. The apparatus as set forth in claim 5 additionally comprising means for positioning aid extended portion of said impacting member and said extended portion of said support member at said selected elevations within said container when said impacting member is in said second position, said positioning means including:

a. handle means which is connected to said impacting member so that axial movement of said handle means causes corresponding axial movement of said impacting member so that said extended portion of said impacting member is located at selected elevations within said container; and b. means, operatively associated with said handle means, for engaging said support member so that said axial movement of said handle means causes corresponding movement of said extended portion of said support member to maintain said upward support of said extended portion of said flexible member.

10. The apparatus as set forth in claim 9 wherein said engaging means includes a spring member for biasing said support member in a first direction, and such that movement of said handle means in said first direction to cause movement of said extended portion of said impacting member in said container causes said spring member to compress, further movement of said handle means in said first direction causes said support member to move in said first direction as a result of said compression of said spring member in a manner such that said extended portions of said impacting member and said support member move together during said further movement of said handle means.

11. The apparatus as set forth in claim 6 wherein:

a. said first end segment of said impacting member is a rubber-like tubular member; and b. said first end segment of said support member is a spring member helically engaged about said impacting member first end segment.

12. The apparatus as set forth in claim 5 wherein:

a. said support member jackets a selected axial length of said impacting member first end segment to support said extended portion of said impacting member in a substantially upwardly directed manner when said sleeve member is in said second position; and b. said sleeve member jackets a selected axial length of said support member first end segment to support said extended portion of said support member in a substantially upwardly directed manner when said sleeve member is said second position.

* * * * *